United States Patent [19]

Watkins, Jr.

[11] Patent Number: 4,651,996

[45] Date of Patent: Mar. 24, 1987

[54] GAME BOARD METHOD

[76] Inventor: Ray R. Watkins, Jr., R.R. 1, Newton, Ill. 62448

[21] Appl. No.: 838,699

[22] Filed: Mar. 12, 1986

[51] Int. Cl.[4] ..... A63F 3/00

[52] U.S. Cl. ..... 273/271

[58] Field of Search ..... 273/271, 275

[56] References Cited

U.S. PATENT DOCUMENTS

| | | | |
|---|---|---|---|
| 1,564,746 | 12/1925 | Barnard | 273/271 |
| 3,342,493 | 9/1967 | Lang . | |
| 3,561,774 | 2/1971 | Brinser . | |
| 3,891,219 | 6/1975 | Foerst | 273/271 X |
| 3,977,681 | 8/1976 | Deitrich . | |
| 4,138,120 | 2/1979 | Daitzman | 273/271 |
| 4,180,271 | 12/1979 | McMurchie | 273/275 |
| 4,254,957 | 3/1981 | Kramer | 273/271 |
| 4,303,246 | 12/1981 | Strongin | 273/271 |
| 4,381,112 | 4/1983 | Dupuy | 273/271 X |
| 4,456,261 | 6/1984 | Daitzman | 273/271 |

*Primary Examiner*—Harland S. Skogquist

*Attorney, Agent, or Firm*—Emrich & Dithmar

[57] ABSTRACT

A rectangular game board includes four base lines each forming an edge of the board. A plurality of spaced locations are designated on an upper surface of the game board such as by circles or squares to form a rectangular matrix of playing spaces comprised of equally spaced rows and columns aligned perpendicular to one pair of facing edges and parallel to the other pair of facing edges of the board. A row of such playing spaces is aligned along and is positioned adjacent to each base line of the board and defines a base row thereon. The game begins with a first player positioning a first playing piece on a playing space of one of the base rows. A second player then positions a second playing piece on either an unoccupied playing space in the same or another designated base row, or on the playing space immediately adjacent to the occupied playing space and in the same row or column as the occupied playing space so as to be positioned toward the center of the board with respect thereto. The game continues with the alternating positioning of the first and second types of playing pieces by the two players, or two teams, on an unoccupied playing space in one of the designated base rows or on an unoccupied playing space immediately adjacent to an occupied playing space in either the same row or column so as to be connected to a designated base row by a continuous, straight column or row of occupied playing spaces until a predetermined number of playing pieces of one of the players are aligned in a single row or column or are aligned diagonally so as to form a linear, continuous pattern.

7 Claims, 6 Drawing Figures

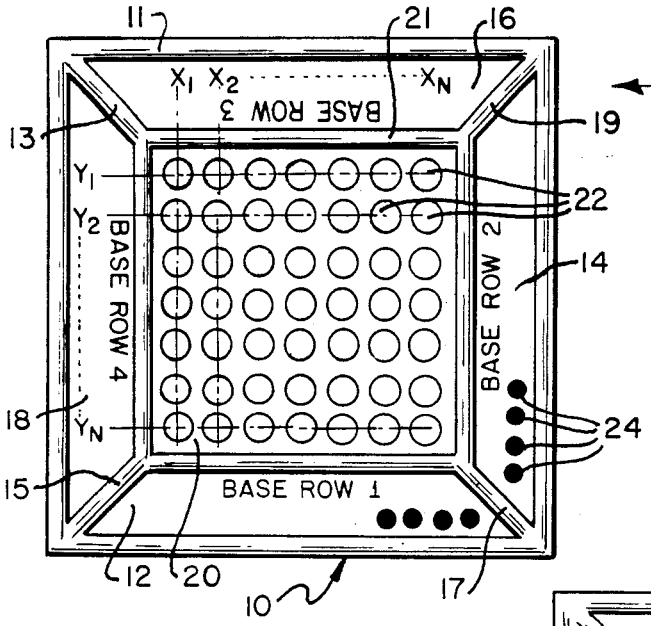
FIG. 1
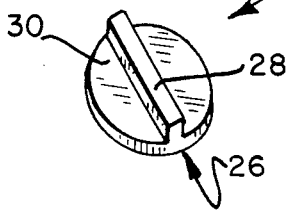
FIG. 4
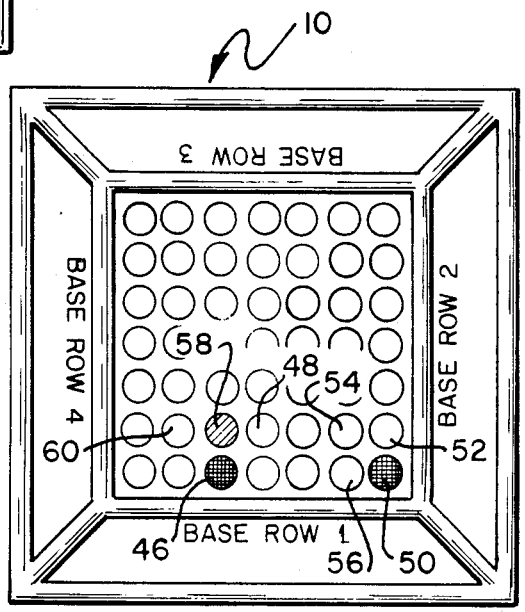
FIG. 2
FIG. 6
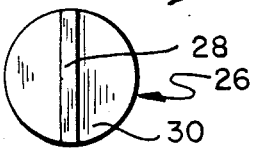
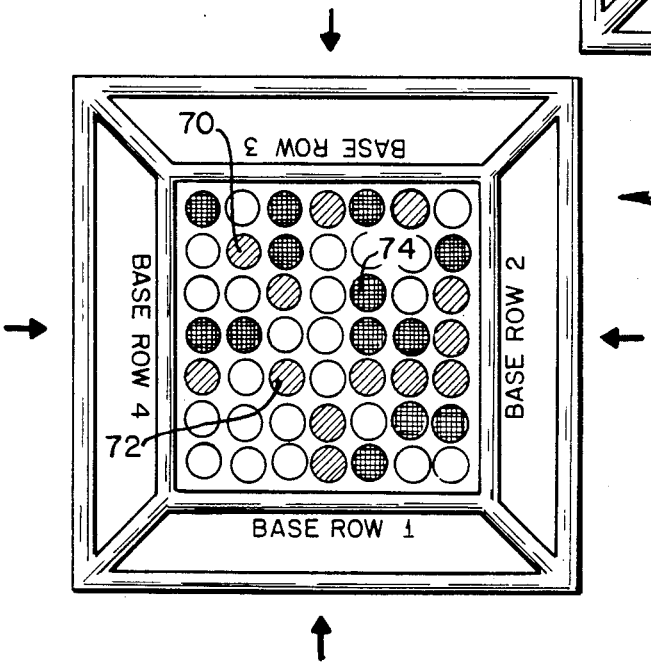
FIG. 3
FIG. 5
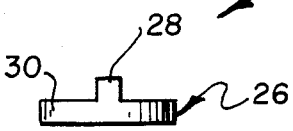

GAME BOARD METHOD

BACKGROUND OF THE INVENTION

This invention relates generally to a board game and is particularly directed to a game board method having as an object the positioning of a predetermined number of playing pieces in a continuous, linear pattern on the board.

Games involving the positioning of playing pieces on a board having a plurality of playing spaces in a fixed, predetermined pattern are well known. Such game boards frequently take the form of a rectangular array of playing spaces whereon a player may position a playing piece, with the object of the game being to position one's playing pieces in a given array, such as in a straight line. Tic-tack-toe is perhaps the most popular game which makes use of the aforementioned playing principles. A similar game known as "Connect Four" employs a generally vertically oriented frame for holding playing pieces such as marbles deposited in the frame in vertically oriented columns wherein the players attempt to align a predetermined number of playing pieces in a linear array within the support frame.

In an effort to increase the complexity of such games and to appeal to a greater age range, many of these games have been expanded into a three-dimensional arrangement wherein the playing pieces may be aligned either in a single plane or in a plurality of planes. Adding another dimension to the game requires the use of a supporting frame which is not only substantially more expensive than a conventional two-dimensional game apparatus, but also involves considerable manipulation by the players in the positioning of playing pieces in a desired position. Whether designed for play in either two or three dimensions, such games are generally intended for use by only two players.

The present invention overcomes the limitations of the prior art by providing a board game method which can be played at varying levels of complexity using the same two-dimensional game board. In addition, the game board and method therefor of the present invention is designed for play by two players or two teams of two players each.

OBJECTS AND SUMMARY OF THE INVENTION

Accordingly, it is an object of the present invention to provide a game board and method therefor wherein the number of players and complexity of the game may be established as desired.

It is another object of the present invention to provide a game board method which allows for changing the complexity of the game without a modification to the game board or to the playing pieces.

Yet another object of the present invention is to provide a game which can be played by two or four players.

A further object of the present invention is to provide a method of playing a board game wherein the object is to position a plurality of playing pieces of one player or team on the board in a continuous, linear array.

A still further object of the present invention is to provide a method of playing a board game which can be played by children and adults wherein the degree of difficulty may be established to match the capabilities of the players by a simple rule change without modification of the board or of the playing pieces.

The present invention contemplates a board game and method therefor which makes use of a rectangular game board which is provided with an orthogonal grid pattern comprised of rows and columns, the intersections of which define a plurality of playing spaces. Positioned adjacent to each edge of the board is a respective base row comprised of a plurality of playing spaces. Play begins with a first player positioning a first playing piece on a playing space in any of the designated base rows. The other player may then place a second playing piece either on an unoccupied playing space in any of the designated base rows or on an unoccupied playing space immediately adjacent to an already occupied playing space. A playing piece positioned in the space immediately adjacent to the occupied base row playing space may be positioned in either the same row or same column with respect to the occupied base row space, but not diagonally with respect thereto. Subsequently positioned playing pieces must be positioned immediately adjacent to an occupied playing space such that each playing piece thus positioned is connected to a designated base row by means of a continuous linear array of playing spaces occupied by one or both types of playing pieces. Play continues until either player positions a predetermined number of his respective playing pieces in either a continuous row, a column, or a diagonal array. A player wins when a predetermined number of his playing pieces are aligned in a linear, continuous array. In a preferred embodiment, each base row is comprised of seven playing spaces with the game played until four playing pieces of one player or team are aligned in a continouus row, column or diagonal array. Either two, three or four base rows may be designated for use, with the complexity of the game increased with the use of a greater number of base rows. The game also may be played with either two or four players. With four players, each pair of two players plays as a team.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 1 is a plan view of a game board utilized in playing the game of the present invention;

FIG. 2 illustrates the method of playing a game on the game board of FIG. 1 in accordance with the principles of the present invention;

FIG. 3 illustrates the game board of FIG. 1 showing a plurality of playing pieces of both types positioned thereon in a typical game situation; and FIGS. 4–6 show various views of playing pieces used in a preferred embodiment in playing the game board of FIG. 1.

DETAILED DESCRIPTION OF THE PREFERRED EMBODIMENT

Referring to FIG. 1, there is shown a top plan view of a game board 10 for use in playing the game of the present invention. The game board 10 is generally square in shape and includes a plurality of upraised peripheral ribs 11 around the periphery thereof. A plurality of inner ribs 21 are each positioned in a spaced manner toward the center of the game board 10 with respect to an associated peripheral rib 11. Each of the upraised peripheral ribs 11 is connected at respective ends thereof to immediately adjacent, adjoining peripheral ribs. Similarly, each of the inner ribs 21 is connected at respective ends thereof to an immediately adjacent inner rib so as to form a substantially closed structure open at the top. A plurality of connecting ribs 13 are positioned adjacent to each of the corners of the game board 10 and connect adjacent respective portions of the peripheral ribs 11 and inner ribs 21 so as to form first, second, third and fourth receptacles 12, 14, 16 and 18. Each of these receptacles forms a generally closed compartment open at the top and is adapted to receive a plurality of playing pieces 24 as shown for the case of the first and second receptacles 12, 14 in FIG. 1.

The inner ribs 21 form a closed structure open at the top and define the periphery, or edges, of the playing portion 20 of the game board 10. Positioned in an orthogonal array on the inner playing portion 20 of the game board 10 are a plurality of playing spaces 22. The playing spaces 22 are arranged in the form of $X_1$ through $X_N$ columns and $Y_l$ through $Y_N$ rows. In a preferred embodiment of the present invention, $N=7$ with the playing spaces 22 thus arranged in a $7\times7$ matrix on the inner playing portion 20 of the game board 10.

In one embodiment of the game board 10, the playing spaces 22 are each defined by a respective circular aperture in the upper surface of the inner playing portion 20 of the game board 10. Where each of the playing spaces 22 is defined by a respective circular aperture, a playing piece 26 such as shown in FIGS. 4 through 6 could be used with such a game board configuration. FIGS. 4, 5 and 6 respectively illustrate upper perspective, end-on, and top plan views of the playing piece 26. The playing piece 26 includes a disc-shaped base 30 upon which is positioned and securely attached an elongated handle 28. The handle 28 facilitates gripping engagement of the playing piece 26 by a player, while the disc-shaped base 30 provides for stable and secure positioning of the playing piece in a circular playing space on the game board. While FIG. 1 shows the playing spaces 22 as defined by a plurality of spaced circles, the playing spaces may similarly be defined by virtually any orthogonally arranged, spaced array of marks or lines on the inner playing portion 20 of the game board 10. For example, the intersections of a first parallel array of spaced straight lines with a second parallel array of spaced straight lines, where the two arrays of lines are oriented orthogonally with respect to one another, could be used to define the playing spaces on the game board.

The manner in which the game board 10 is used in practicing the board game method of the present invention is as follows. Prior to initiating play of the game, two or more of the base rows are designated for use. The two designated base rows may face each other as in the case of base rows 1 and 3, or they may be positioned immediately adjacent to one another as in the case of base rows 1 and 2, base rows 2 and 3, etc., as shown in FIG. 2. Similarly, any three or all four of the base rows may be designated for use during the game. Two sets of playing pieces are used in playing the game, with each set of playing pieces number 1 through 25 in a preferred embodiment. Thus, a preferred embodiment of the present invention makes use of a game board having a $7\times7$ matrix of playing spaces with each player or team having 25 numbered playing pieces. Each playing piece may be provided with an identifying number on a bottom portion thereof. Each player or representative of a team selects one of the opponent's playing pieces to begin the game, with the higher numbered playing piece thus selected designating that player or team which is to go first.

Play is initiated by a first player positioning one of his playing pieces on a playing space in one of the designated base rows. Thus, where base rows 1 and 3 are designated for play, the first player may position one of his playing pieces on a playing space in either of these two base rows such as shown for playing piece 46 in FIG. 2. The second player, or team, may position its first playing piece in either: (1) any vacant playing space in base row 1; (2) any playing space in base row 3; or (3) in the space immediately adjacent to the occupied base row playing space in either the same row or column as the occupied base row space, but not diagonally with respect thereto. For example, where the first player positions his first playing piece 46 as indicated in FIG. 2, the second player may position his first playing piece in any playing space in base row 3, in any unoccupied playing space in base row 1, or as indicated for the location of playing piece 58. Playing spaces 48 and 60 are illegal spaces for the second player in the positioning of his first playing piece on the game board.

Where the first player positions his first playing piece in a corner playing space on the game board such as shown for playing piece 50, the second player may position one of his playing pieces in any vacant playing space in base rows 1 and 3. However, the second player may not position a playing piece in the playing space designated 54 in FIG. 2 when the other player has positioned one of his respective playing pieces in the space occupied by playing piece 50 unless another playing piece of either of the players is positioned on playing space 52 or 56.

After both players have positioned their first respective playing pieces on the game board, play continues in an alternating manner, wherein each playing piece may be positioned on either an unoccupied base row playing space or may be positioned on a playing space immediately adjacent to an occupied playing space, where the playing piece thus positioned is connected to an authorized base row by a continuous, linear array of occupied playing spaces. These occupied playing spaces may be occupied by playing pieces of either type. Play continues until one of the players has arranged four of his playing pieces in a continuous straight line either diagonally or along a given row or column on the game board. It has been found that with the game board comprised of a $7\times7$ matrix of playing spaces, the preferred number of playing pieces of one player thus arranged in a continuous linear array on the board for winning the game is four. Where the size of the game board is greater than a $7\times7$ matrix, a corresponding greater number of linearly arranged playing pieces of a single player may be required for winning the game. Similarly, where the game board is smaller than a $7\times7$ matrix, the winning number of consecutive, linearly aligned playing pieces required to win the game may be specified to be less than four.

Referring to FIG. 3, there is shown a plurality of playing pieces of both types positioned on the game board as an example of the manner in which the game board method of the present invention is to be played. The arrows shown around the periphery of the game board illustrate the respective directions of proper positioning of playing pieces relative to the various base rows. In the example of FIG. 3, all four base rows are being used in playing of the game method. All of the playing pieces illustrated in FIG. 3, with the exception of playing pieces 70, 72 and 74, are legally positioned in accordance with the game board method of the present invention. However, playing pieces 70, 72 and 74 are not connected to one of the designated base rows by a linear, continuous array of playing pieces positioned upon the playing board. All of the other playing pieces illustrated in FIG. 3 are connected to one of the four designated base rows by a continuous, linear array of playing pieces positioned upon the playing board. The continuous, linear array of playing pieces connecting a playing piece to a base row must be aligned perpendicular to one of the base rows and not diagonally with respect thereto. However, in winning the game, a predetermined number of playing pieces of the same type may be arranged in a diagonal, linear continuous array on the game board and do not necessarily have to be aligned with one of the rows or columns of the game board.

Each set of playing pieces of the respective players or teams is provided with a distinguishing characteristic such as having all playing pieces of one player of a first color and all playing pieces of the other player of a second, different color. The number of players which may play the game of the present invention may either be two or four. When the game is played by four players, the players are divided up into two teams of two players each. With two players involved, each player has 25 playing pieces, with 49 possible plays available per game for each player. Where four players are involved and the players are divided into two teams of two players each, each team is provided with 25 playing pieces. The starting player of each team should be provided with 13 playing pieces, while the second player of each team would make use of the remaining 12 playing pieces. If the game is played to the point where all of the playing spaces are occupied before a player wins, the last player, or team, will not be able to place his last playing piece on the game board. Thus, the inability of the player who does not go first to utilize his last playing piece where the game board is filled and still no one has yet won, provides the player who goes first with a very slight advantage. Once play has begun, the players may place their playing pieces anywhere they choose so long as each placing piece is positioned on a designated base row or connected to a designated base row by a continuous row or column of occupied playing spaces. A player may connect his playing piece to a designated base row by using either his own playing pieces, his opponent's playing pieces, or a combination of both players' playing pieces. Once a playing piece is positioned on the game board, it cannot be removed until the game is completed.

It has been found that children in the age group 6–8 are capable of playing the game of the present invention where two facing base rows are designated for use. Children aged 9 and above as well as adults can play the game with two, three or four base rows designated for use. As the number of designated base rows increases, the number of options for positioning playing pieces on the game board increases and thus the complexity of the game increases. The game board of the present invention is easily constructed and may be comprised of paper and thus be disposable. The game board may also be comprised of cardboard, a magnetic material which makes use of magnetized playing pieces, or the game board may be of the erasable type wherein the image of the board is permanently affixed to the game board with the playing pieces or marks erasable by lifting a plastic sheet up for re-use. Finally, the faceplate of a cathode ray tube in a computer terminal may be used for playing the game of the present invention.

There has thus been shown a game board and method therefor comprised of a square matrix of playing spaces and including a plurality of base rows around the periphery or edges thereof. Two or four players playing as two teams may play the game wherein each player or team alternately positions one of his/their respective playing pieces on the game board in attempting to arrange a predetermined number of similar playing pieces of one player or team in a linear continuous array either diagonally or in a column or row on the game board. Each player is limited to the positioning of playing pieces on either a designated base row or in a playing space connected either by one's own playing pieces, the opponent's playing pieces or a combination of both to a base line.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A method for aligning a predetermined number of playing pieces of either a first type associated with a first player or team or of a second type associated with a second player or team in a linear pattern on a generally rectangular game board, said game board including a plurality of playing spaces arranged in a plurality of orthogonally oriented M rows and N columns and defined by a plurality of edges, wherein each edge of said game board has associated therewith a respective base row of playing spaces positioned adjacent thereto, said method comprising:

designating first and second base rows for use;

positioning a first type of playing piece on a playing space of said first designated base row;

positioning a second type of playing piece either: (1) on a playing space of said second designated base row; (2) on an unoccupied playing space of said first designated base row; or (3) on the playing space immediately adjacent to the occupied playing space in the first designated base row and in the same row or column as the occupied playing space in the first designated base row but not diagonally with respect thereto; and alternately positioning the first and second types of playing pieces on the game board on unoccupied playing spaces either in a designated base row or connected to a designated base row by a continuous array of playing pieces of the first type, or of the second type, or a combination thereof, aligned with a given row or column of the game board until a predetermined number of playing pieces of either the first type or the second type are arranged in a linear continuous array on the playing spaces of the game board.

2. The method of claim 1 further comprising the step of setting M=N in providing a square game board having four base rows with an equal number of playing spaces.

3. The method of claim 2 further comprising the step of setting M=N=7 in providing each of the four base rows of the game board with 7 playing spaces.

4. The method of claim 3 further comprising the step of designating the predetermined number of playing pieces of either the first or second type arranged in a linear continuous array defining the end of the game board method to be 4.

5. The method of claim 2 further designating a third base row for use.

6. The method of claim 5 further designating a fourth base row for use.

7. The method off claim 6 further comprising the steps of assigning two players to each of the first and second teams.

* * * * *